US008267286B2

(12) United States Patent
Smrt et al.

(10) Patent No.: US 8,267,286 B2
(45) Date of Patent: Sep. 18, 2012

(54) SPRAY CAN ACTUATOR CAP

(76) Inventors: Thomas M. Smrt, Cary, IL (US); John F. Smrt, Cary, IL (US)

( * ) Notice: Subject to any disclaimer, the term of this patent is extended or adjusted under 35 U.S.C. 154(b) by 504 days.

(21) Appl. No.: 12/534,496

(22) Filed: Aug. 3, 2009

(65) Prior Publication Data

US 2011/0024460 A1 Feb. 3, 2011

(51) Int. Cl.
*B65D 83/00* (2006.01)
*B67D 7/06* (2010.01)

(52) U.S. Cl. ..... 222/402.11; 222/182; 222/402.1; 222/402.13

(58) Field of Classification Search ..... 222/174, 222/402.1, 402.11, 402.13, 402.14, 402.15, 222/182
See application file for complete search history.

(56) References Cited

U.S. PATENT DOCUMENTS 3,726,444 A * 4/1973 Ostrowsky et al. ..... 222/402.11
3,726,445 A * 4/1973 Ostrowsky et al. ..... 222/402.11
4,186,853 A * 2/1980 White ..... 222/182
5,368,202 A * 11/1994 Smrt ..... 222/174
5,518,148 A * 5/1996 Smrt ..... 222/174
5,769,279 A * 6/1998 Smrt ..... 222/174
5,791,524 A * 8/1998 Demarest ..... 222/153.06
6,758,412 B2 * 7/2004 Aberegg et al. ..... 239/337
6,866,165 B2 * 3/2005 Heathcock et al. ..... 222/174
7,296,713 B2 * 11/2007 Mineau et al. ..... 222/182
7,308,992 B1 * 12/2007 Mineau et al. ..... 222/182
2005/0211733 A1 * 9/2005 Healy et al. ..... 222/402.1
2005/0218162 A1 * 10/2005 Healy et al. ..... 222/402.1

* cited by examiner

*Primary Examiner* — Kevin P Shaver
*Assistant Examiner* — Stephanie E Williams
(74) *Attorney, Agent, or Firm* — Husch Blackwell LLP; Jon P. Christensen

(57) ABSTRACT

An actuator cap for a pressurized aerosol spray can for the dispensing of marking compositions consists of an outer housing, an inner housing, and a rotatably mounted spray tip. The outer housing employs an annular chime for use with devices for remotely actuating pressurized aerosol spray cans. The inner housing connectively couples to various pressurized aerosol spray cans. The spray tip allows for efficient dispensing of marking composition through the pressurized aerosol spray can valve while also preventing accidental sideways discharge.

8 Claims, 4 Drawing Sheets

SPRAY CAN ACTUATOR CAP

TECHNICAL FIELD

The various embodiments of the present invention are directed to a device for discharging the contents of aerosol spray cans onto a surface and thereby marking that surface, and more particularly to an actuator device for actuating the valve of an aerosol spray can.

BACKGROUND OF THE INVENTION

It is well known to use aerosol spray cans for dispensing marking compositions. For example, aerosol spray cans are often used for marking or striping parking lots, construction sites, sporting fields, and factory floors. Devices have been developed for use with aerosol spray cans which allow a person making such marks or stripes to actuate the valve of a pressurized aerosol spray can. These devices are often integrated into a molded cap with means for attachment to the aerosol spray can. These devices further allow the discharge of the marking compositions from the spray can to be manually controlled by the user.

Previous methods and devices for aerosol spray can actuation use cap assemblies consisting of several pieces. This previous method suffers from several deficiencies. Cap assemblies consisting of multiple pieces have a higher associated manufacturing cost, and are also prone to damage or wear through extensive use. Other previous methods for spray can cap assemblies are prone to accidental sideways discharge of the marking composition. An aerosol spray can may be actuated by displacing the valve-actuator angularly away from its normal vertical orientation. This property of common aerosol spray cans allows for the valve-actuator to be displaced from its closed vertical position at any number of given angles. In other words, the valve-actuator can be tipped away from the spray can's longitudinal axis at any radial angle. This often results in accidental sideways discharge of marking composition in previous spray can actuator devices.

Pressurized aerosol spray cans can be remotely supported and actuated by devices such as disclosed in U.S. Pat. No. 5,518,148 and incorporated herein by reference as if set forth in full herein. Such remote actuating devices guide the spray can into the proper position based on an annular ridge built into the top of certain aerosol spray cans. However, not every aerosol spray can contains such a ridge, and therefore these aerosol spray cans are not compatible with remote spray can actuators as described above.

Therefore, there is a continuing need for an inexpensive, single-body construction device for an aerosol spray can actuator that allows for compatibility with various different styles and sizes of aerosol spray can actuators, and further reduces the occurrence of accidental sideways discharge.

CONCISE DESCRIPTION OF THE DRAWINGS

SUMMARY OF THE INVENTION

Embodiments of the present invention meet the needs described above in an aerosol spray can actuator. Generally described, the present invention is a device for actuating the valve of an aerosol spray can. An actuator cap for a pressurized aerosol spray can for the dispensing of marking compositions consists of an outer housing, an inner housing, and a rotatably mounted spray tip. The outer housing employs an annular chime for use with devices for remotely actuating pressurized aerosol spray cans. The inner housing connectively couples to various pressurized aerosol spray cans. The spray tip allows for efficient dispensing of marking composition through the pressurized aerosol spray can valve while also preventing accidental sideways discharge.

DETAILED DESCRIPTION

In accordance with one embodiment of the present invention, there is provided an actuator cap for a pressurized aerosol spray can for the dispensing of marking compositions. The actuator cap prevents the operator from manually discharging the contents of the spray can in a sideways direction. The present invention provides a relatively simple mechanism wherein the single-piece actuator cap provides an annular chime for aerosol spray cans lacking such an annular chime.

Figure 1:
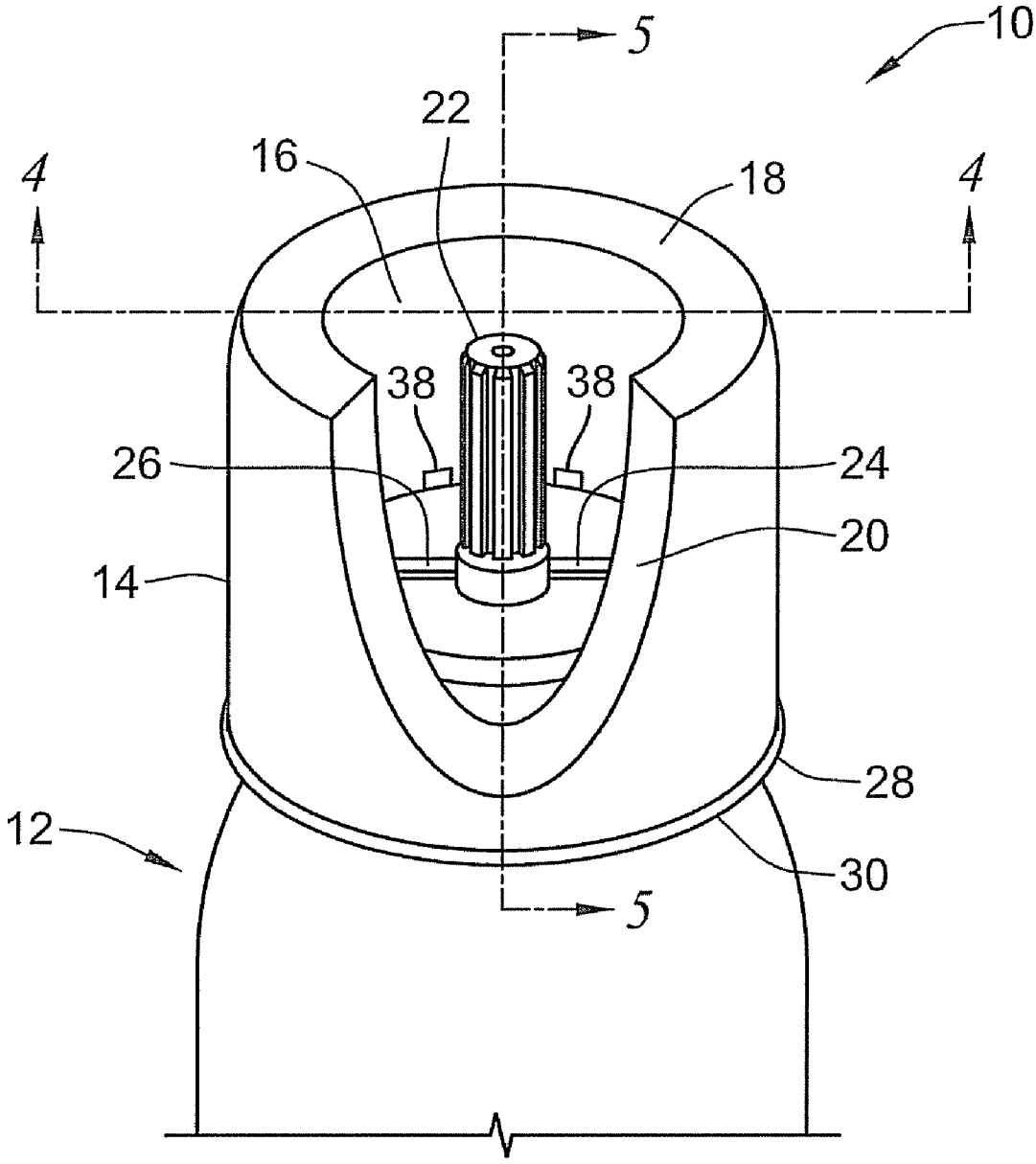
FIG. 1 depicts a perspective view of an aerosol spray can actuator cap shown in use with an aerosol spray can.

Referring now to FIG. 1, the actuator cap device 10 of the present invention shown in use with a conventional aerosol spray can 12 designed to be discharged in the inverted position. The aerosol spray can 12 includes an actuator valve mounted thereon (not shown) that moves between discharging and non-discharging positions, thereby controlling the discharge of the contents of the aerosol spray can 12.

The actuator cap device 10 includes two housings, an outer housing 14 and an inner housing 16. Outer housing 14 is connectively coupled to inner housing 16 by top face 18 and side opening face 20. Outer housing 14 generally aligns with the outer wall of aerosol spray can 12, while inner housing 16 generally aligns with the mounting cup 34 of the valve assembly 40 of the spray can 12. The actuator cap device 10 also includes spray tip 22. Spray tip 22 is generally cylindrical. Spray tip 22 has a hollow core for dispensing the marking composition expelled from the actuator valve of the aerosol spray can 12. Spray tip 22 slidably engages the actuator valve when the actuator cap assembly is engaged with the mounting cup of the valve assembly as will be explained in more detail below.

Spray tip 22 is rotatably coupled to inner housing 16 by cross members 24 and 26. Cross members 24 and 26 are coupled to spray tip 22 proximal to the base of spray tip 22 near the actuator valve of aerosol spray can 12. Cross members 24 and 26 extend radially outward from the base of spray tip 22. Cross members 24 and 26 extend from opposite sides of the base of spray tip 22. Therefore, cross members 24 and 26 are co-linear with each other. Cross members 24 and 26 attach proximal to the base rim of inner housing 16 near the mounting cup of the valve assembly of aerosol spray can 12.

As mentioned above, actuator cap device 10 includes inner housing 16 and outer housing 14. Inner housing 16 is configured such that inwardly-facing retaining tabs 38 are spaced radially about the bottom rim of inner housing 16. The retaining tabs are designed to engage the mounting cup of the valve assembly of aerosol spray can 12. The diameter of inner housing 16 is such that when the actuator cap device is forced down on to the top of the aerosol spray can, the retaining tabs engage the mounting cup of the valve assembly and are splayed outward. Further downward force will cause the retaining tabs to snap over and below the mounting cup of the valve assembly of a conventional aerosol spray can, thereby affixing the actuator cap device to aerosol spray can 12.

The cylindrical outer housing 14 is generally coaxial with inner housing 16. The outer housing 14 provides a finished appearance to the aerosol spray can 12 and a comfortable surface for the user to grip. The outer housing 14 terminates prior to intersecting with the tapered wall of the aerosol spray can 12, thereby creating a gap 28 between the annular chime 30 of outer housing 14 and the tapered wall of the aerosol spray can 12.

The actuator cap device 10 of the present invention is operated by pushing against the spray tip 22, thereby displacing the actuator stem 36 of the aerosol spray can and opening the valve of the aerosol the spray can. By exerting a lateral force relative to the vertical axis of the cylindrical spray tip 22, and perpendicular to the rotational axis of cross members 24 and 26, a user may dispense marking composition from the aerosol spray can 12. Previous methods of actuator devices employed a spray tip that could be tilted in any radial direction relative to the axis of the spray can. The free-tilting nature of these methods resulted in accidental sideways discharge. Cross members 24 and 26 act cooperatively as a guide to prevent accidental sideways discharge. Cross members 24 and 26 are resilient, deformable structures. Cross members 24 and 26 derive their flexibility from a combination of resilient materials, geometry and thickness. When a lateral force is applied to the top end of spray tip 22, cross members 24 and 26 only allow spray tip 22 to tilt in a plane perpendicular to the rotational axis of the cross members. After the user removes the lateral force applied to the spray tip 22, cross members 24 and 26 return to their original orientation.

Previous spray can actuator cap devices do not include annular chimes. Instead, previous spray can actuator cap devices rely on the annular chime built in to certain types of aerosol spray cans. The ridge or chime is formed where the cylindrical sidewall intersects with and engages the domed top portion of the spray can. However, certain other types of aerosol spray cans do not employ an annular chime at the top of the spray can that can be used as a stop by remotely-actuated aerosol spraying devices. These types of aerosol spray cans have a curved, tapered side wall ending near the mounting cup of the valve assembly. These types of spray cans are difficult to position within remotely-actuated aerosol spraying devices because the profile of the can is devoid of protrusions or ridges.

Figure 2:
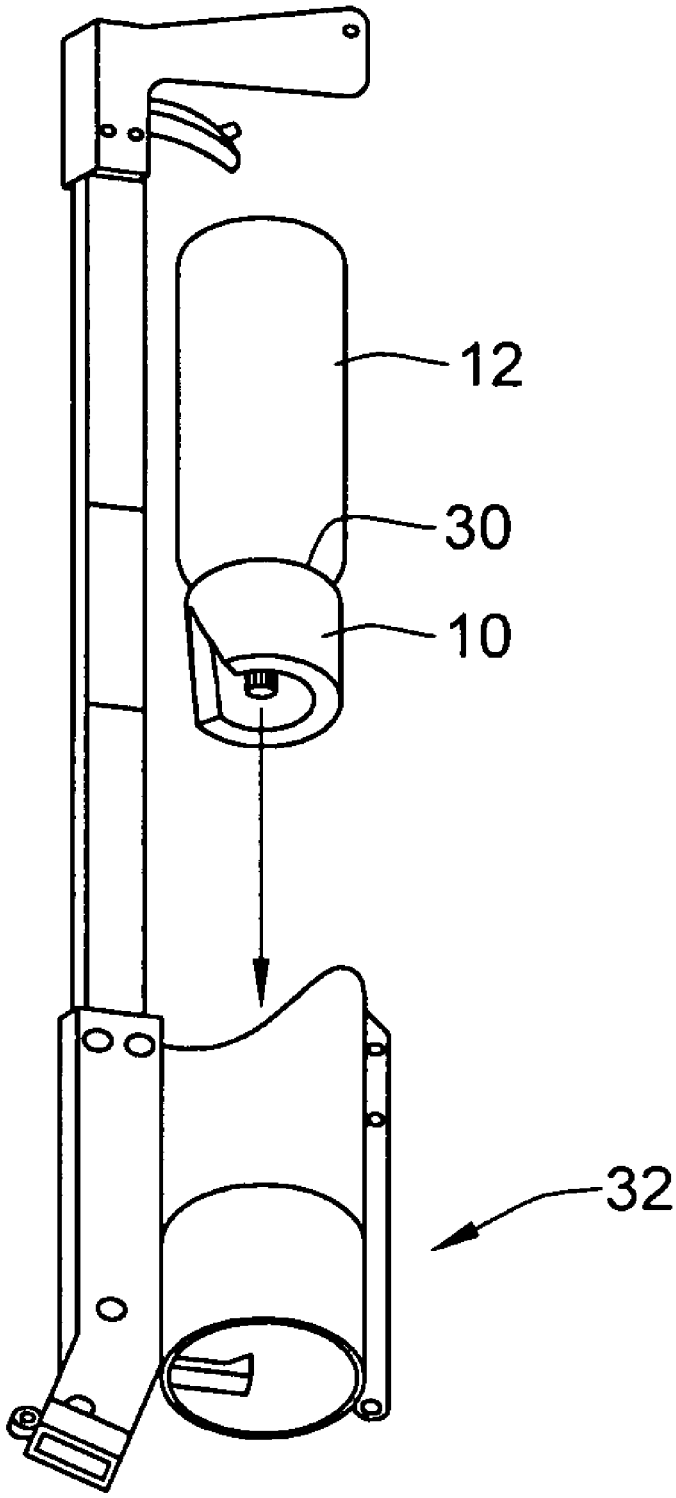
FIG. 2 depicts a perspective view illustrating engagement of one type of aerosol spray can with the remote actuating device.
Figure 3:
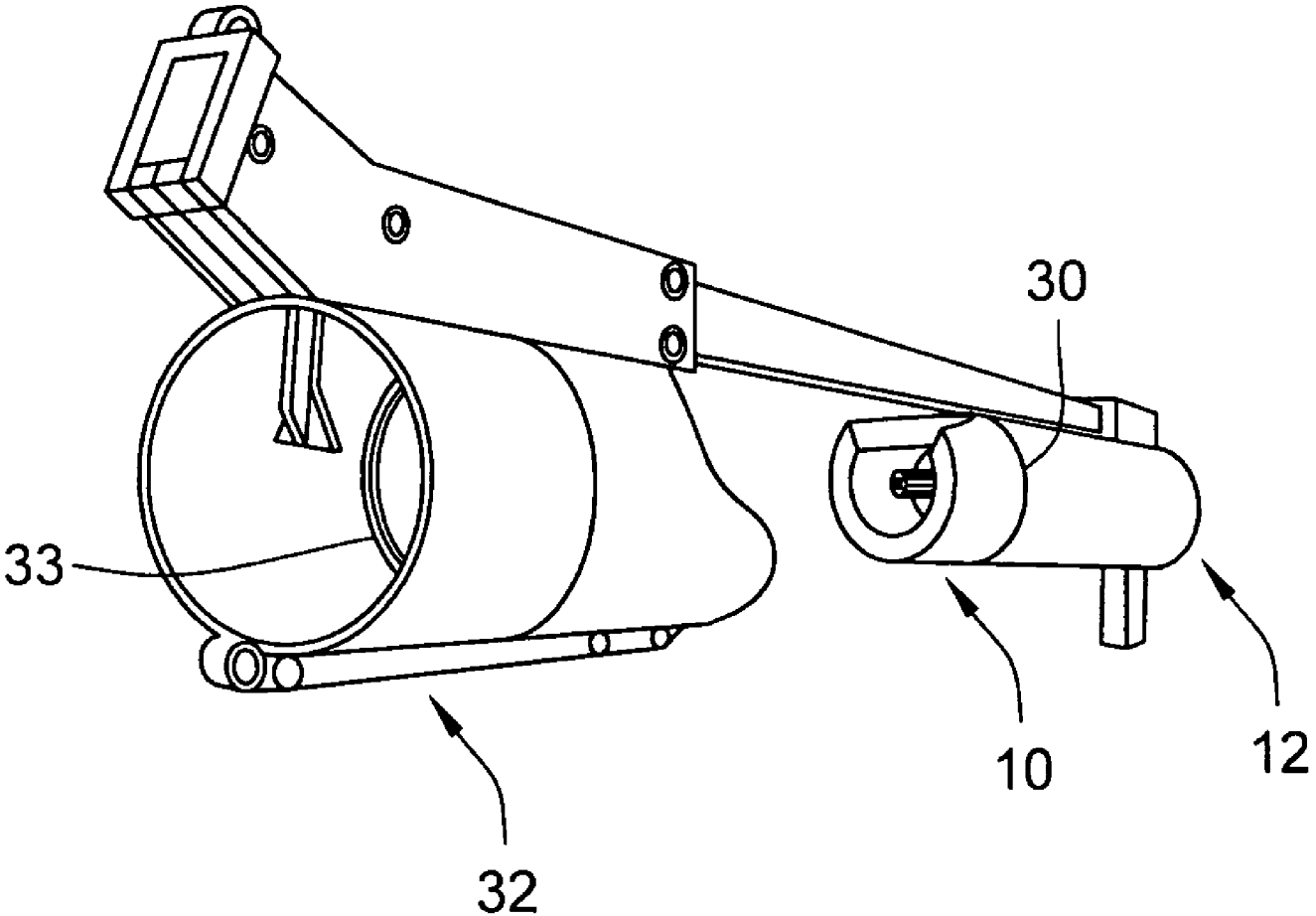
FIG. 3 depicts a perspective view of the operation of the annular ridge of the aerosol spray can actuator cap.
Figure 4:
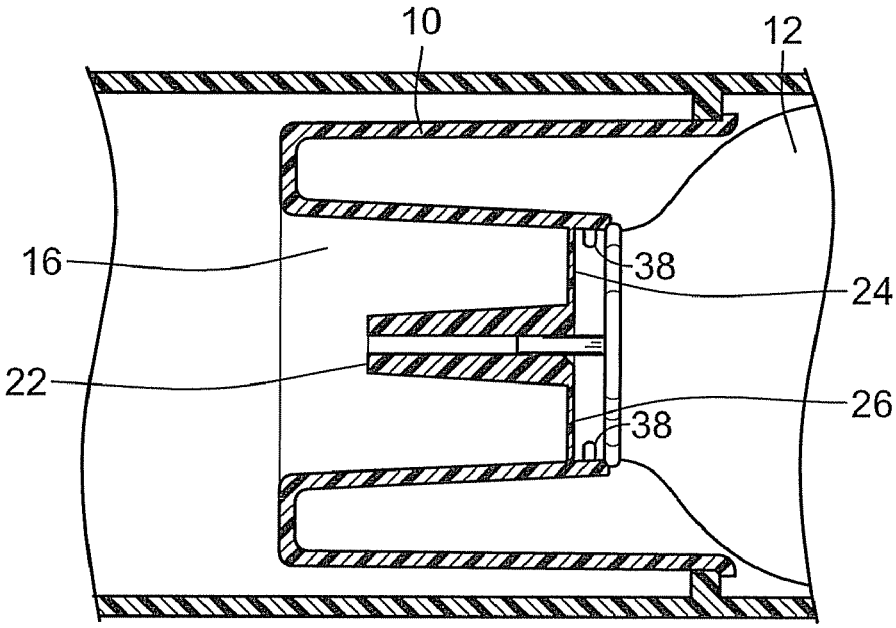
FIG. 4 is cut-away views of the cap device 10 of FIG. 1 along line 4-4.
Figure 5:
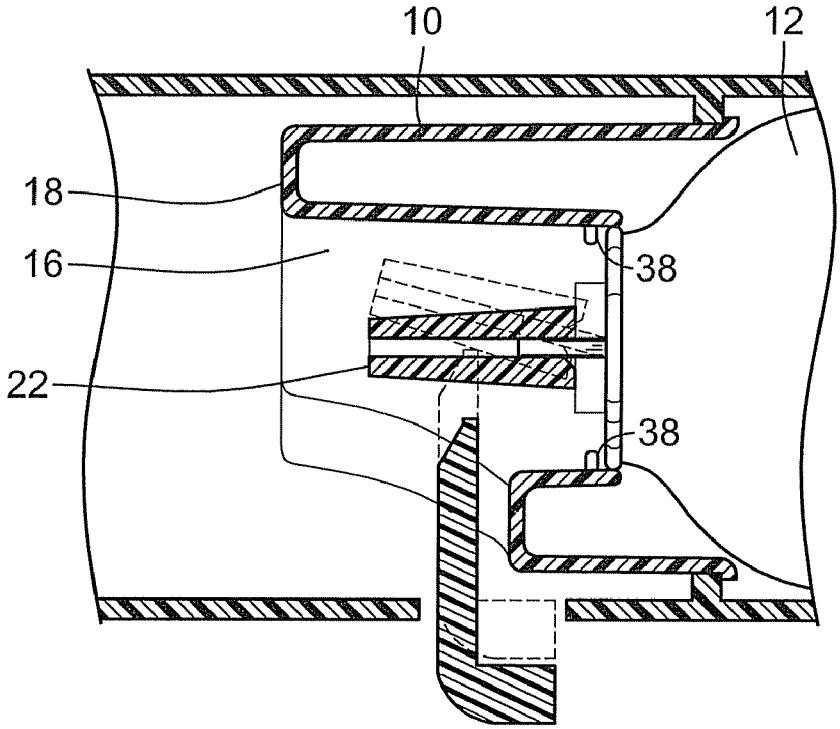
FIG. 5 is cut-away views of the cap device 10 of FIG. 1 along line 5-5.

As shown in FIG. 1, actuator cap 10 includes an annular chime 30 for engaging remotely-actuated aerosol spraying devices. The annlular chime 30 is positioned at the base of the outer housing 14 of the spray cap device 10. The annular chime 30 is positioned in substantially the same location relative to the spray can 12 as are the annular chimes of spray cans with built-in annular chimes. As shown in FIG. 2, aerosol spray can 12 with attached actuator cap 10 and annular chime 30 can be held within a remote spraying device 32 as described in U.S. Pat. No. 5,518,148. As can be seen more clearly in FIG. 3, the annular chime 30 of actuator cap 10 acts as a stop to position the aerosol spray can 12 within the housing of the remote spraying device 32. The annular chime 30 of actuator cap 10 also acts in cooperation with the housing of the remote spraying device 32 to prevent the spray can 12 from being inserted too far into the housing, or from passing completely through the housing. A retaining wall positioned within the housing of the remote spraying device 32 serves to properly position the aerosol can 12 within the housing.

While the components of the foregoing devices which allow a user to control the discharge of the aerosol spray can held at a remote distance from the user have been described herein in connection with certain preferred embodiments, those skilled in the art will appreciate that the present invention is equally applicable to other aerosol spray can discharging devices.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments and equivalents falling within the scope of the appended claims.

Various features of the invention are set forth in the following claims.

What is claimed is:

1. An actuator cap for an aerosol spray can comprising:

an outer housing with a cylindrical sidewall generally aligned with an outer wall of the aerosol spray can, wherein a raised annular chime extends along a base of the outer housing, the raised annular chime is formed where the cylindrical sidewall intersects with and engages a domed top portion of an aerosol spray can, the chime being adapted to allow aerosol spray cans without such a chime to be used with remote spray can actuators;

an inner housing, the outer housing is generally coaxial with the inner housing, the inner housing defines a cylindrical opening extending through the inner housing, that is generally aligned with a mounting cup of a valve assembly of the aerosol spray can, the inner housing connectively coupled to the outer housing by a top face and a side opening face, the side opening extending through the inner and outer housings;

a plurality of inwardly facing retaining tabs spaced radially about a bottom rim of the inner housing, the retaining tabs are designed to engage the mounting cup of the aerosol spray can; and an elongated cylindrical spray tip centered within the cylindrical opening, the elongated cylindrical spray tip extends from a first end proximate the inwardly facing retaining tabs towards the top face, the elongated cylindrical spray tip is connectively coupled to the inner housing on the first end by a first cross member and a second cross member that allows the elongated cylindrical spray tip to tilt within the cylindrical opening, the spray tip having a hollow core that dispenses a marking composition of the aerosol spray can when the elongated cylindrical spray tip is tilted relative to the cylindrical opening, wherein the spray tip has an engaging base on the first end and a dispensing spray end, wherein the engaging base of the spray tip slidably engages an actuator valve stem of the aerosol spray can.

2. The actuator cap of claim 1, wherein the spray tip is rotatably coupled to the inner housing by the first and the second cross members, wherein the cross members are coupled to the spray tip proximal to the base of the spray tip near the actuator valve of the aerosol spray can.

3. The actuator cap of claim 1, wherein the first and the second cross members extend radially outward from the base of the spray tip.

4. The actuator cap of claim 3, wherein the first and the second cross members extend from opposite sides of the base of the spray tip.

5. The actuator cap of claim 1, wherein the retaining tabs engage the mounting cup of the valve assembly of the aerosol spray can.

6. The actuator cap of claim 1, wherein the inner housing diameter allows the plurality of retaining tabs to snap over and below the mounting cup of the valve assembly of the aerosol spray can.

7. The actuator cap of claim 1, wherein when a lateral force is applied to the spray tip, the first and the second cross members cooperate to force the spray tip to tilt in a plane perpendicular to the rotational axis of the first and the second cross member.

8. The actuator cap of claim 7, wherein when the lateral force applied to the spray tip is removed, the first and the second cross members return to their original orientation.

* * * * *